United States Patent [19]

Djordjevic

[11] Patent Number: 5,046,987

[45] Date of Patent: Sep. 10, 1991

[54] TOY BOXER ARMS

[76] Inventor: Simeon Djordjevic, 2339 Guilford, Abbotsford, British Columbia, Canada, V2S 4Z3

[21] Appl. No.: 403,274

[22] Filed: Sep. 5, 1989

[51] Int. Cl.[5] ..... A63H 13/02

[52] U.S. Cl. ..... 446/336; 446/365

[58] Field of Search ..... 446/268, 308, 312, 317, 446/330, 331, 333, 334, 336, 339, 352, 354, 365, 366, 376, 381, 385, 490, 335, 359; 40/418, 419

[56] References Cited

U.S. PATENT DOCUMENTS

| | | | |
|---|---|---|---|
| 1,658,054 | 2/1928 | Levy . | |
| 1,799,735 | 4/1931 | Crowell | 446/334 |
| 1,853,733 | 4/1932 | Lane | 446/334 |
| 2,614,365 | 10/1952 | Musselwhite . | |
| 2,616,700 | 11/1952 | Munro | 446/336 X |
| 2,716,840 | 9/1955 | Armstrong | 446/334 |
| 3,172,401 | 3/1965 | Pullen | 446/308 X |
| 3,728,816 | 4/1973 | Ensmann et al. . | |
| 3,927,883 | 12/1975 | Bosley et al. . | |
| 4,031,657 | 6/1977 | Crosman et al. | 496/333 |
| 4,457,097 | 7/1984 | Miller et al. | 446/334 X |
| 4,553,946 | 11/1985 | Miller | 446/334 X |
| 4,579,543 | 4/1986 | Renger et al. . | |
| 4,596,532 | 6/1986 | Cook et al. . | |
| 4,750,900 | 6/1988 | Hart | 446/359 X |

*Primary Examiner*—Mickey Yu

[57] ABSTRACT

An arm for a doll having a torso with a mounting for the arm fixed in the torso. The arm has an upper arm and a forearm pivotally attached to each other at an elbow having a pivotal axis. The upper arm is pivotally received on the mounting and is able to pivot in a shoulder opening in the torso about a pivotal axis. There is an anchor point on upper arm, offset from the pivotal axis of the upper arm. A second anchor point at the elbow is offset from the elbow pivotal axis and mounted on the forearm. A tendon extends between the two anchor points. The upper arm can be pivoted so that as the upper arm pivots upwardly it extends the forearm. Pivoting of the forearm downwardly retracts the forearm towards the upper arm.

7 Claims, 2 Drawing Sheets

TOY BOXER ARMS

FIELD OF THE INVENTION

This invention relates to an arm for a doll, particularly an arm able to simulate the action of a boxer.

DESCRIPTION OF THE PRIOR ART

Dolls are of extreme antiquity. In every generation particular dolls have been popular and the current trend is to "action" dolls, that is dolls that either simulate soldier, spacemen and the like or, instead of being merely passive, can be operated so that their legs or arms can move. Talking dolls that play a recorded message are also known.

Dolls having moving arms are established in the art and have been known for many generations. However, normally the movement is permitted by the provision of a simple pivotal joint at the shoulder of the doll in which the arm can be manipulated by the child to assume a desired position.

Dolls in which the arms can be moved by springs or by manipulation of another part of the body of the doll are known. Thus, U.S. Pat. No. 4,579,543 to Renger et al discloses an animated toy having a plurality of heads and moveable arms. The toy has a pair of arms of a fixed shape rotatably connected to shoulders by a spring assembly. The arms can be pulled back and released to strike the head on the opposite side of the torso of the doll. However, the forearm and the bicep portion are in one piece.

U.S. Pat. No. 3,728,816 to Ensmann et al discloses a doll having rigid arms that pivot up and down. This reference teaches a motorized mechanism for moving the arm.

U.S. Pat. No. 4,596,532 to Cook et al discloses a doll in which manipulation of one leg produces a horizontal swinging of both arms. This is achieved by a mechanism attached to the legs that controls the movement to the arms. The arms are of single construction.

U.S. Pat. No. 3,927,883 to Bosley et al discloses a boxing apparatus for toy figures. Two simulated boxers are mounted on a rotatable platform. The boxers have arms that are fixed at particular degrees of extension and the rotation of the platform on which the boxers are mounted is used to make the arms swing striking a opponent boxer.

Other prior art known to applicant includes U.S. Pat. No. 1,658,054 to Levy and U.S. Pat. No. 2,614,365 to Musselwhite.

SUMMARY OF THE INVENTION

In contrast to the above prior art the present invention seeks to provide an arm for a doll that can extend and retract and, in particular, includes an elbow joint so that, like a human arm, the arm can move from fully contracted position with the forearm close to the upper arm to a fully extended position, in a more or less straight line.

Accordingly, the present invention provides an arm for a doll having a torso with a mounting for the arm fixed in the torso, the arm having an upper arm and a forearm pivotally attached to each other at an elbow having a pivotal axis, the improvement comprising:

the upper arm being pivotally received on the mounting and able to pivot in a shoulder opening in the torso about a pivotal axis;

a first anchor point in the mounting, offset from the pivotal axis of the upper arm;

a second anchor point at the elbow offset from the elbow pivotal axis and mounted on the forearm;

a tendon extending between the first and second anchor points;

means to pivot the upper arm whereby pivoting of the upper arm upwardly extends the forearm and pivoting of the forearm downwardly retracts the forearm towards the upper arm.

DESCRIPTION OF THE DRAWINGS

Aspects of the invention are illustrated merely by way of example, in the accompanying drawings, in which.

DESCRIPTION OF THE PREFERRED EMBODIMENTS

Figure 1:
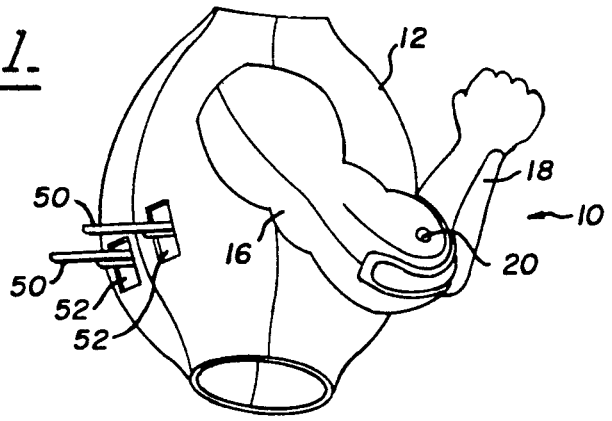
FIG. 1 illustrates an arm of the present invention in retracted positions.
Figure 2:
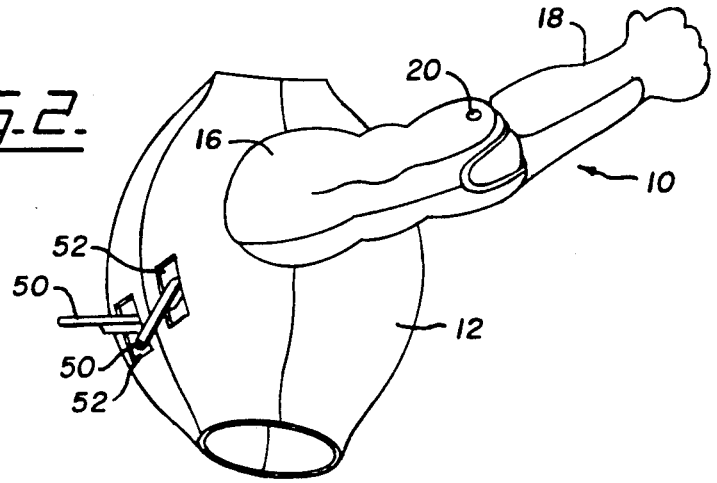
FIG. 2 is similar to FIG. 1 showing the arm in an extending position.

The drawings show an arm 10 for a doll having a torso 12. Only the torso 12 of the doll is shown. As shown particularly in FIG. 3 there is a mounting for the arm fixed in the torso. The mounting comprises a member 14 attached to the front of the torso 12 and extending inwardly. The arm has an upper arm 16 and a forearm 18, pivotally attached to each other at an elbow defined by a pin 20, which also defines a pivotal axis.

The arm 10 has a cavity 22 to receive a disc 24. A shaft 26 extends from the disc 24 into the torso 12 to engage member 14. Thus, the disc 24, shaft 26 and member 14 comprise the mounting for the arm 10. The shaft 26 and the disc 24 are fixed, that is they do not rotate relative to the torso 12.

The upper arm 16 is pivotally received on the shaft 26 and is able to pivot about an axis defined by the shaft 26. The upper arm 16 is also received in a shoulder opening 28 in the torso 12 and is provided with a circumferential channel 30, defined by flange 32 on an extension 34 of the arm extending into the torso 12.

Figure 3:
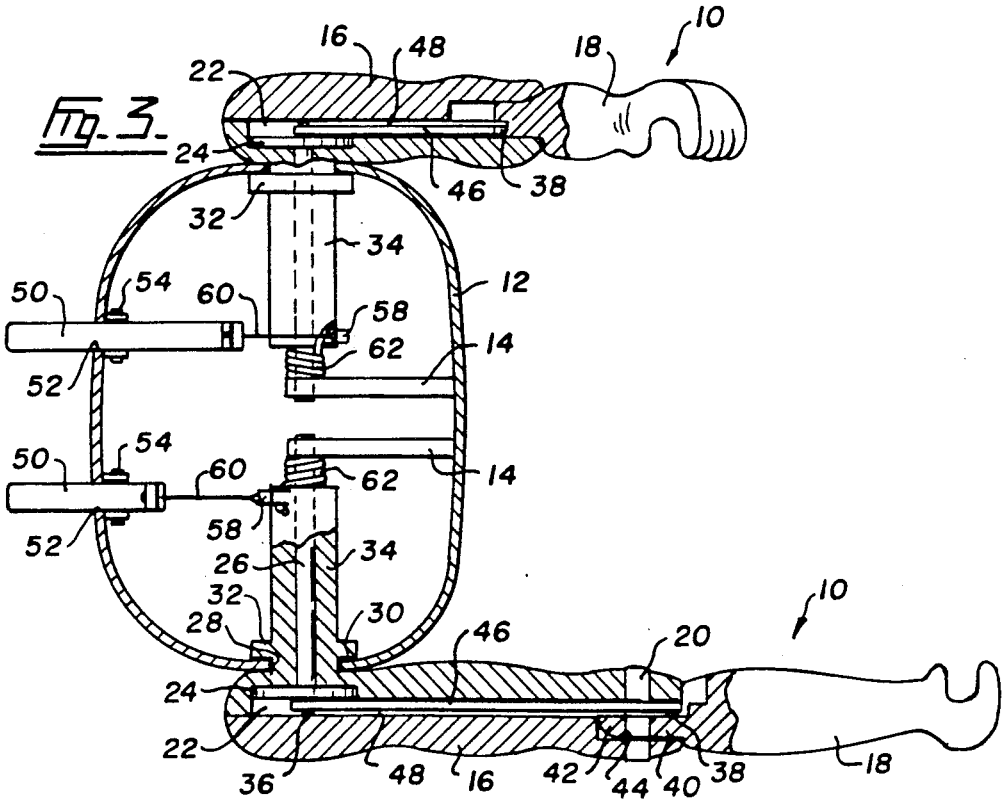
FIG. 3 is a plan view, in section, showing a torso of a doll fitted with two arms according to the present invention.

There is a first anchor point 36 on the arm offset from the pivotal axis defined by the shaft 26. The arrangement is probably most clearly shown in FIGS. 4 to 6. There is a second anchor point 38 at the elbow, offset from the elbow pivotal axis and mounted on the forearm 18. In this regard the forearm joint comprise a cavity 40 in the upper arm 16 through which the pin 20 extends. There is a flat extension 42 in the forearm 18 to extend into the cavity 40. The flat extension 42 includes an opening 44 through which the pin passes. The arrangement is best shown in FIG. 3.

A tendon 46 extends between the first and second anchor 36 and 38 points and is attached to the points. To accommodate the tendon the upper arm is provided with an internal cavity 48. In this regard, to facilitate construction and location of the various components during building the upper arm is best formed in two parts, as shown in FIG. 3.

There are means to pivot the upper arm 16 to obtain the desired extension and retraction of the arm 10. In the illustrated preferred embodiment the means to pivot the upper arm comprises a lever 50 extending through a back opening 52 in the torso 12. The lever 50 is pivotally received in the torso at 54. There is a projection 58 on the arm extension 34 and a flexible link 60 extends between the lever 50 and the projection 58. As shown particularly in FIG. 3, the arm includes a coil spring 62, anchored around the mounting member 14 and the projection 58. This spring 62 urges the arm 10 to the closed position shown in FIG. 1.

Figure 4:
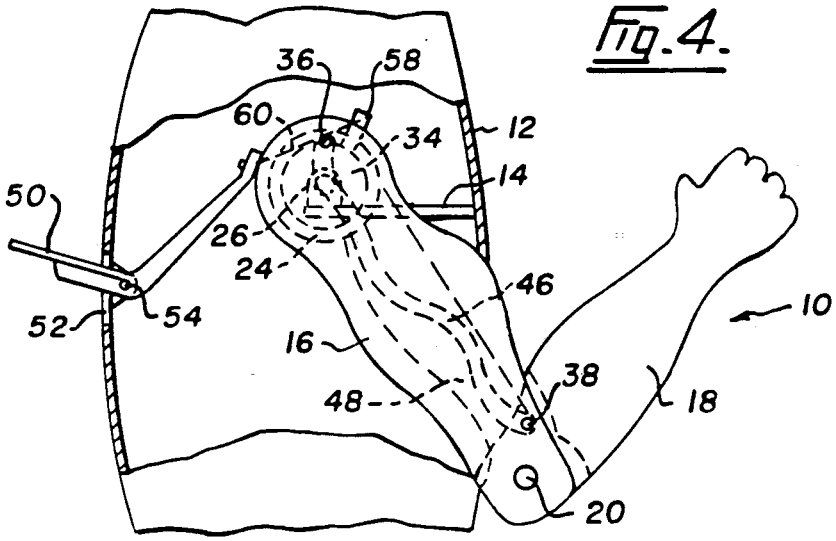
FIGS. 4 to 6 illustrate the operation of the arm of the invention.
Figure 5:
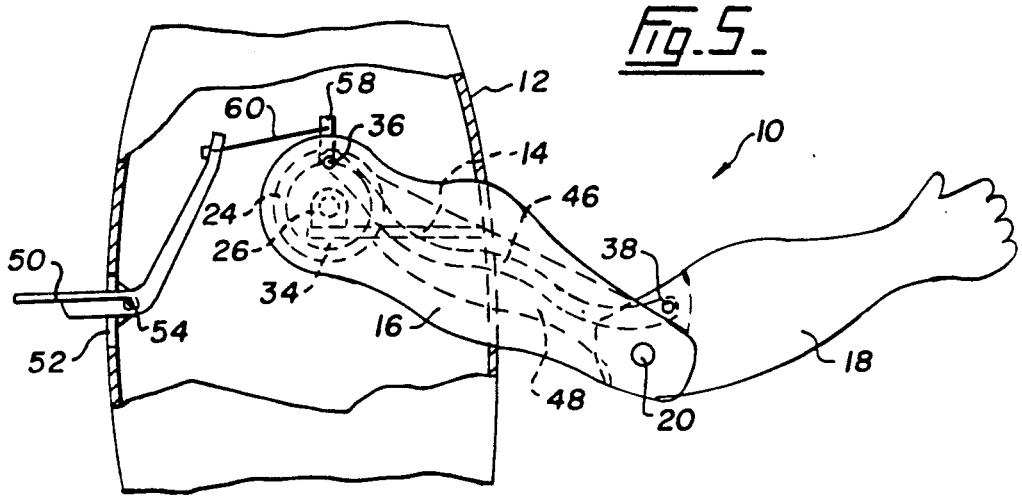
Figure 6:
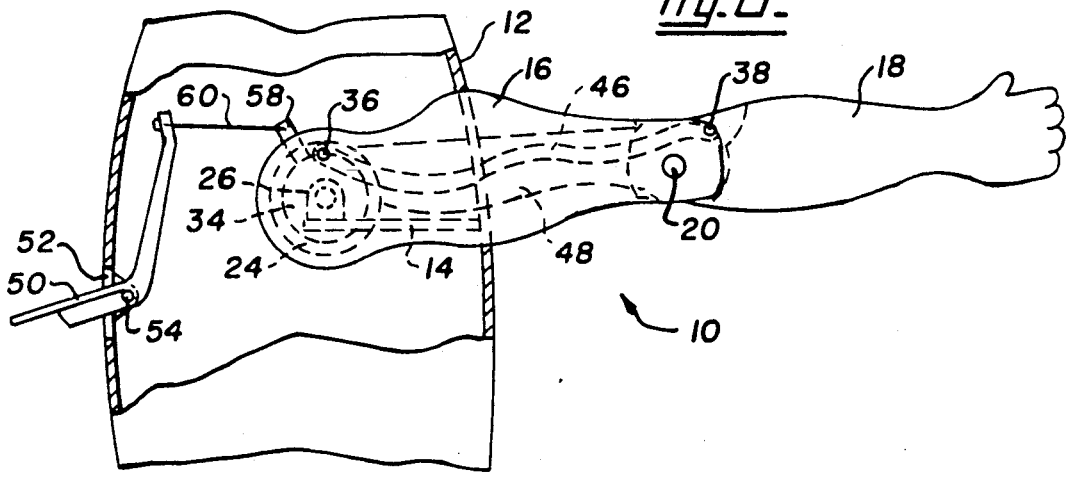

The arm operates as follows. The rest position is shown in FIGS. 1 and 4 and FIG. 3 on the left side. Downward movement of lever 50 about the pivot point 54 moves the projection 58 rearwardly, as shown in the sequence of FIGS. 4, 5 and 6. As the projection 58 moves rearwardly, the upper arm 16 is pivoted upwardly as shown in FIGS. 5 and 6. As a result tendon 46 also pivots the forearm 18 about the pin 20 to straighten the arm as shown in FIGS. 5 and 6.

Thus, moving downwardly of the lever 50 projecting from the back of the torso moves the upper arm upwardly and, simultaneously, straightens the arm by flexing the elbow joint to the position as shown in FIG. 6. Release of the lever 50 means that the spring 62 can return the arm back to the position shown in FIGS. 1 and 4, that is the flexed position.

As shown particularly in FIG. 3 the doll will be provided with two arms according to the present invention but each arm is entirely independent and, in particularly, is operated independently by separate levers 50.

I claim:

1. An arm for a doll having a torso with a mounting for the arm fixed in the torso, the arm having an upper arm and a forearm pivotally attached to each other at an elbow having a pivotal axis, the improvement comprising:

the upper arm being pivotally received on the mounting and able to pivot in a shoulder opening in the torso about a pivotal axis, the upper arm being provided with a channel to engage the edge of the shoulder opening in the torso;

a first anchor point on the upper arm, offset from the pivotal axis of the upper arm;

a second anchor point adjacent the elbow offset from the elbow pivotal axis and mounted on the forearm;

a tendon extending between the first and second anchor points;

means to pivot the upper arm whereby pivoting of the upper arm upwardly extends the forearm and pivoting of the forearm downwardly retracts the forearm towards the upper arm.

2. A doll's arm as claimed in claim 1 in which the mounting for the arm comprises a shaft having an inner and an outer end, the inner end being secured to the torso;

a disc attached to the outer end of the shaft;

a cavity in the upper arm to receive the disc.

3. A doll's arm as claimed in claim 2 including an extension on the upper arm extending into the torso and pivotally received on the shaft.

4. A doll's arm as claimed in claim 3 in which the means to pivot the upper arm comprises a lever extending through a back opening in the torso of the doll; and means connecting the lever to the extension on the upper arm.

5. A doll's arm as claimed in claim 4 in which the lever is pivotally received in the torso;

a projection on the arm extension;

a flexible link between the lever and the projection.

6. A doll's arm as claimed in claim 4 including means urging the upper arm to the lowered position.

7. A doll's arm as claimed in claim 6 in which the means urging the upper arm to the lowered position is a coil spring.

* * * * *